US010105565B2

(12) United States Patent
Reeves, Jr.

(10) Patent No.: US 10,105,565 B2
(45) Date of Patent: Oct. 23, 2018

(54) WEIGHTED STRETCHING AND STRENGTHENING DEVICE

(71) Applicant: Charles Ernest Reeves, Jr., Crawfordville, FL (US)

(72) Inventor: Charles Ernest Reeves, Jr., Crawfordville, FL (US)

( * ) Notice: Subject to any disclaimer, the term of this patent is extended or adjusted under 35 U.S.C. 154(b) by 203 days.

(21) Appl. No.: 15/199,985

(22) Filed: Jul. 1, 2016

(65) Prior Publication Data

US 2017/0007875 A1 Jan. 12, 2017

Related U.S. Application Data

(60) Provisional application No. 62/189,324, filed on Jul. 7, 2015.

(51) Int. Cl.
*A63B 21/072* (2006.01)
*A63B 21/06* (2006.01)

(52) U.S. Cl.
CPC ..... *A63B 21/0604* (2013.01); *A63B 21/0608* (2013.01); *A63B 21/072* (2013.01)

(58) Field of Classification Search
CPC ..... A63B 21/0604; A63B 21/0607; A63B 21/0608; A63B 21/072; A63B 2069/0008
USPC ..... 482/109
See application file for complete search history.

(56) References Cited

U.S. PATENT DOCUMENTS 1,316,683 A * 9/1919 Calvert ..... A63B 21/072 473/125
3,414,260 A * 12/1968 Gust ..... A63B 15/00 473/256
5,362,059 A * 11/1994 Grossman ..... A63B 21/0088 473/228
7,303,458 B1 * 12/2007 Wolfinbarger ..... A63H 33/02 446/236
D616,949 S * 6/2010 Wang ..... D21/682
7,846,076 B2 * 12/2010 Salzwimmer ..... A63B 19/00 482/110
7,883,452 B1 * 2/2011 Chen ..... A63B 21/072 482/108
8,979,719 B2 * 3/2015 Januszek ..... A63B 21/072 482/106
9,079,070 B2 * 7/2015 Reynolds ..... A63B 21/072
9,126,082 B2 * 9/2015 Schacht ..... A63B 69/3638
2009/0093348 A1 * 4/2009 Wang ..... A63B 21/0603 482/93
2011/0306475 A1 * 12/2011 Caswell ..... A63B 21/0601 482/93
2016/0151657 A1 * 6/2016 Kugielsky ..... A63B 21/072 482/93

* cited by examiner

*Primary Examiner* — Joshua T Kennedy

(57) ABSTRACT

A weighted stretching and strengthening device for exercise. This invention encourages a proper conditioning of the body's muscles and joints before playing in any sport that requires a swinging motion. This device enables the player to establish end range movements in the upper body, increases stamina to enhance a players striking ability, and, in turn, could help reduce injuries. This invention provides the player with a universal warm up and strengthening device that is durable, safe and easy to use.

5 Claims, 4 Drawing Sheets

WEIGHTED STRETCHING AND STRENGTHENING DEVICE

CROSS-REFERENCE TO RELATED APPLICATIONS

This application claims priority to and the full benefit of U.S. Provisional Application Ser. No. 62/189,324, filed Jul. 7, 2015.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not Applicable

BACKGROUND OF THE INVENTION

People that play in games using tangible projectiles or sports which require striking a ball with a bat, club, or racquet, sometimes suffer bodily injuries from not being prepared for the activity. Sports players are encouraged to warm up with stretching exercises prior to participating in a game or practice. Players often attach a counterweight to a bat or club or use a weighted device to stretch the muscles and condition the joints in preparation for the activity. Some weighted devices are difficult or awkward to use, while the addition of a removable weight to a striking device is inconvenient and could potentially impose safety issues if not attached properly. I invented this weighted stretching and strengthening device to provide a safe, easy way for people to condition their upper body for exercise and sports. This invention can be defined under U.S. patent classifications 472 and 473.

BRIEF SUMMARY OF THE INVENTION

Unlike other stretching devices, this invention is an oval shaped tube with an extended, stationary weight and covered with a durable material that allows multiple gripping positions. Swinging this device stretches the muscles by extending the normal range of motion that is required to swing a bat, club, racquet, or any other device used in activities to strike an object. Repeating the swinging motion with this weighted tube device can also strengthen the body by using the weight to target muscles required to make these movements. This invention is an improvement on what currently exists because this weighted stretching and strengthening device is a single unit with an extended, stationary weight that provides a more convenient and safe way to prepare the body for activity.

DETAILED DESCRIPTION OF THE INVENTION

Figure 1:
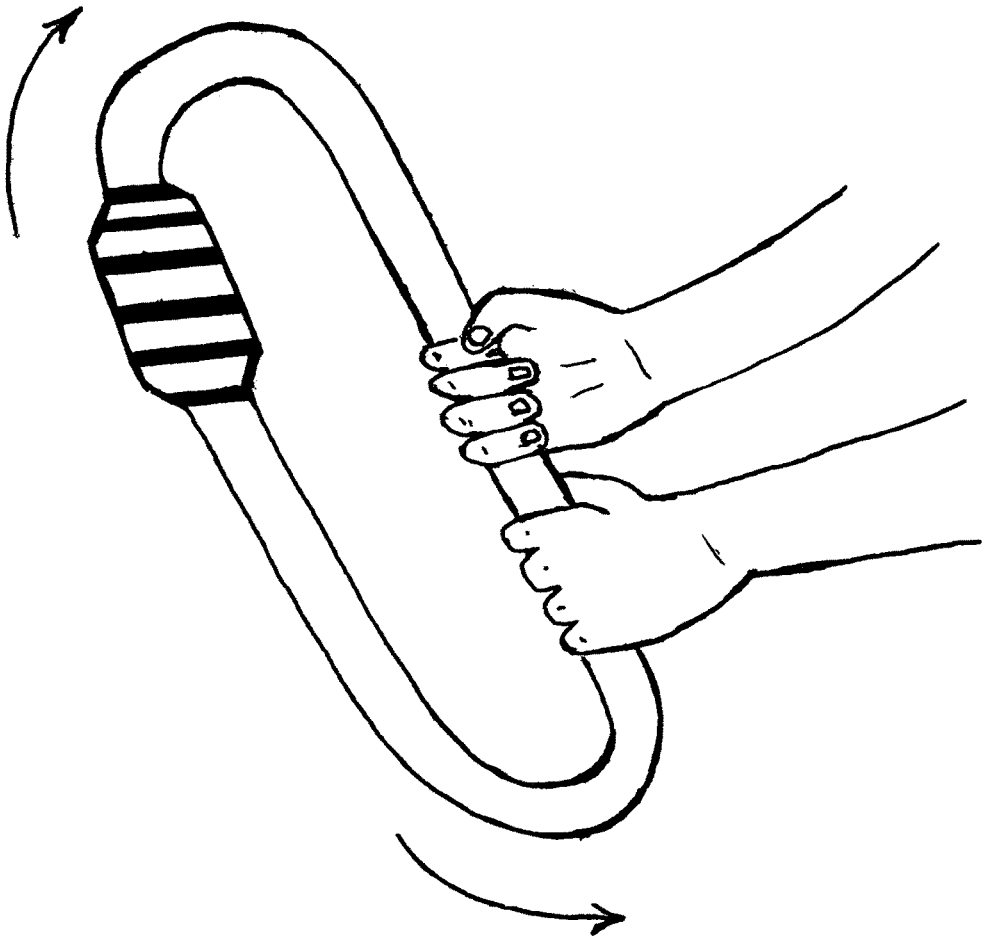
FIG. 1 is an illustration of a weighted stretching and strengthening device of disclosure held in hands with arrows showing directional motion.
Figure 1A:
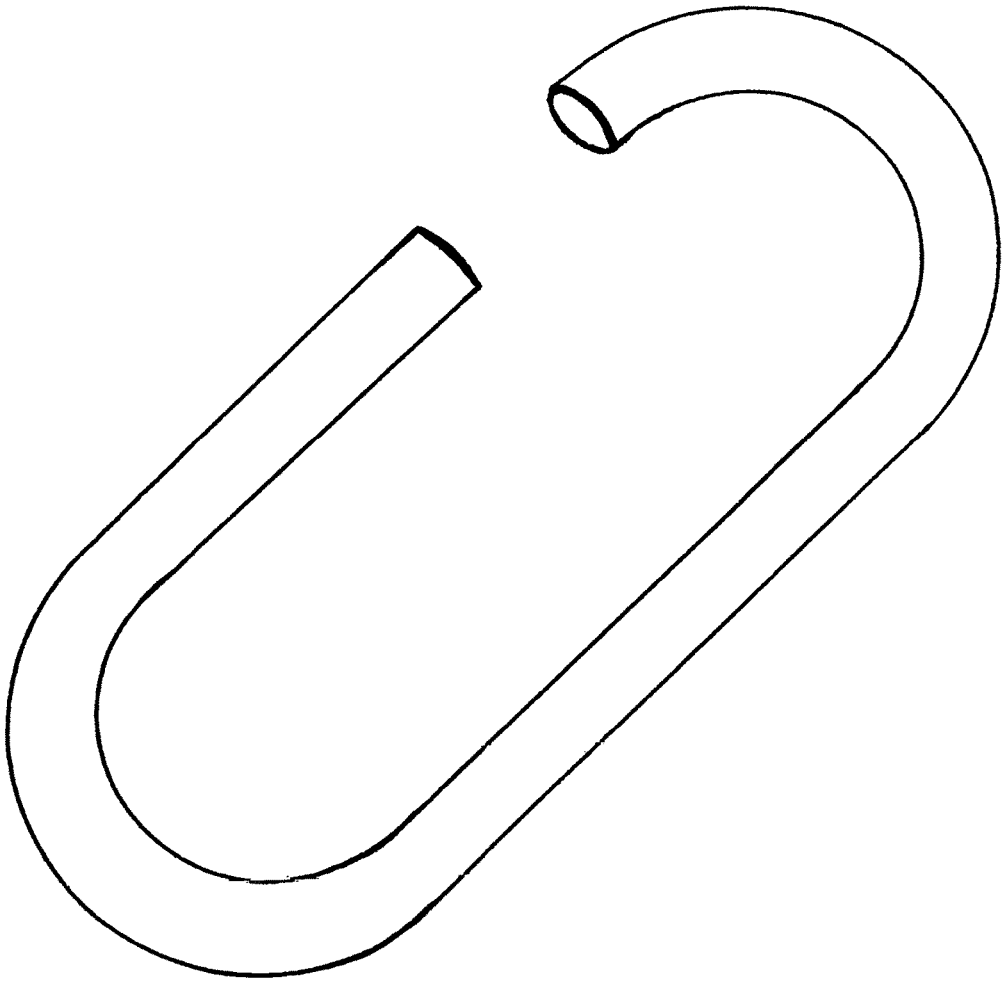
FIG. 1A is an illustration of an oval shaped metal tube frame used to make a weighted stretching and strengthening device.

This weighted stretching and strengthening device, as depicted in FIG. 1 of the drawings, is a combination of an oval shaped tube, a stationary weight, and a protective outer layer. The tubing diameter, the weight mass, and the weight position are determined by the size and ability of a person using this device; thus a variety of tube and weight combinations could be used to make a weighted stretching and strengthening device. The version of the invention claimed here can be made by using the listed components and following the detailed process below:

A. An oval shaped metal tube frame, as depicted in FIG. 1A of the drawings, made of 1 inch electrical magnetic tubing (EMT).

Figure 1B:
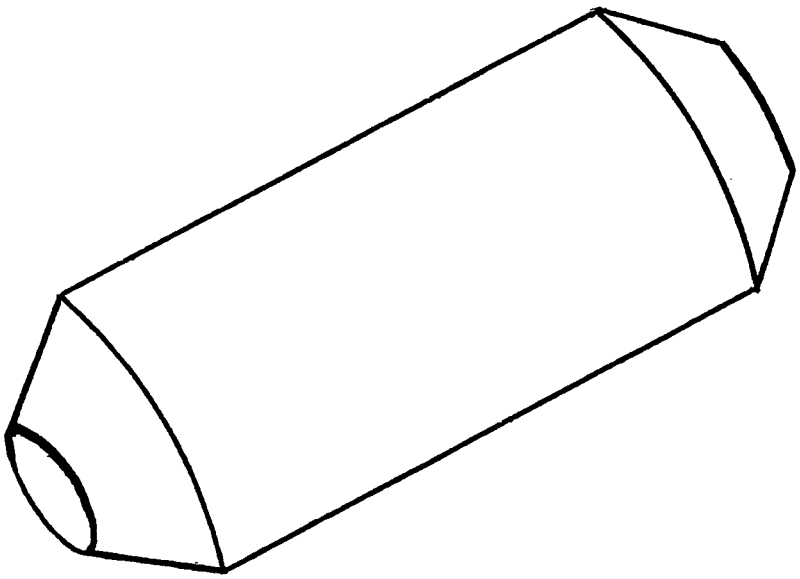
FIG. 1B is an illustration of a cylindrical shaped weight used to make a weighted stretching and strengthening device.

B. A cylindrical shaped weight, as depicted in FIG. 1B of the drawings, made of 2 inch steel round bar.

Figure 1C:
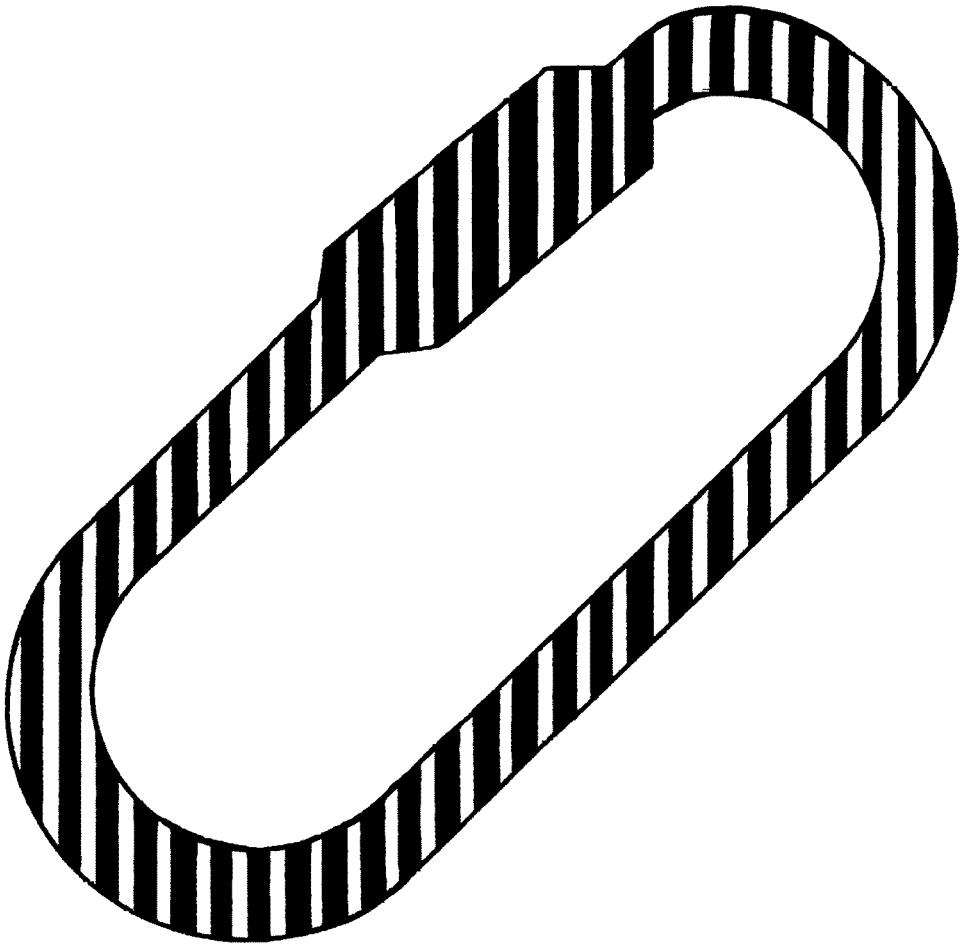
FIG. 1C is an illustration of a weighted stretching and strengthening device wholly covered with a protective material known as heat shrink tubing.

C. A protective coating, as depicted in FIG. 1C of the drawings, made of 3 inch heat shrink tubing.

D. A protective coating, as depicted in FIG. 1C of the drawings, made of 35 millimeter heat shrink tubing.

The EMT is cut to a length of 48 inches and bent from each end using a tube bender with an 8 inch die to form the oval shape. The steel round bar is cut to a length of 6 inches and machined using a metal lathe to drill a 17/32 inch by 1 inch deep hole in the center of each end to form a recess; then cutting a 20 degree angle around the perimeter of each end; then to drill four 3/16 inch opposite holes at each end from the center of the angled perimeter to the center of the recess; thus forming the weight. The 3 inch heat shrink tubing is cut to a length of 8 inches and the 35 millimeter heat shrink tubing is cut to a length of 52 inches, and both are then put onto the oval shaped metal tube. The weight is then placed between the void in the metal tubing, and the metal tubing then pressed into the recesses of the weight. Screws are then affixed through the holes at each end of the weight to secure the weight to the metal tubing. The 35 millimeter heat shrink tubing is then positioned around the entire oval shaped metal tube and heated to form a tight bond. The 3 inch heat shrink tubing is then positioned over the weight and heated to form a tight bond.

All together, these components make a version of this claimed invention. The weight is used to increase the range of motion that a person would normally establish by using a bat, club, racquet, or any other device used in activities to strike an object. The oval tube is used to extend the weight away from the hands and also allows the person to hold this invention in a range of positions to target different muscle groups in the upper body. The heat shrink tubing is used as a protective coating around the steel components and also provides a gripping attribute.

This weighted stretching and strengthening device is simple and safe to use. A person would grip the device in their hand or hands and swing from side to side, up and down, and in the same motion of the sports device being used in a particular activity. Being a single unit with a stationary weight, this invention provides people with a safe way to condition their upper body for exercise and sports.

The invention claimed is:

1. A weighted stretching and strengthening device comprising an oval shaped metal tube frame defined by two parallel sides connected by two symmetrical rounded end portions, each of said sides having a length and a center point; and a cylindrical shaped weight having a larger diameter and a smaller length than that of said parallel sides, said cylindrical shaped weight is attached in-line on one of said parallel sides between said two symmetrical rounded end portions such that a center of mass of said weight lies in-line, but off center in relation to the length of said one of said parallel sides.

2. A weighted stretching and strengthening device as claimed in claim 1: wherein the parallel sides are elongated to at least encompass two adjacent hands.

3. A weighted stretching and strengthening device as claimed in claim 1: wherein the tubing of the said oval shaped metal tube frame maintains a diameter enabling the gripping of hands.

4. A weighted stretching and strengthening device as claimed in claim 1: wherein the cylindrical shaped weight is a solid mass in the shape of a cylinder with ends that taper into said one of said parallel sides.

5. A weighted stretching and strengthening device at claimed in claim 1: wherein the assembly of the said oval shaped metal tube frame and the said cylindrical shaped weight is wholly covered with a protective material.

* * * * *